United States Patent [19]

Sato

[11] 4,224,872

[45] Sep. 30, 1980

[54] LABEL STRIP JAM PREVENTING MECHANISM FOR HAND LABELER

[75] Inventor: Yo Sato, Tokyo, Japan

[73] Assignee: Kabushiki Kaisha Sato Kenkyusho, Tokyo, Japan

[21] Appl. No.: 938,421

[22] Filed: Aug. 31, 1978

[30] Foreign Application Priority Data

Sep. 5, 1977 [JP] Japan ..... 52/105795

[51] Int. Cl.[2] ..... B41F 1/08; B65C 9/18; B65C 11/02

[52] U.S. Cl. ..... 101/288; 101/297; 156/384; 156/541; 156/577; 156/579; 156/584; 156/DIG. 33; 156/DIG. 49

[58] Field of Search ..... 156/384, 574, 577, 579, 156/584, 541, 277, DIG. 33, DIG. 49; 101/288, 287, 291, 292, 297; 400/134.5, 134.6

[56] References Cited

U.S. PATENT DOCUMENTS

| | | | |
|---|---|---|---|
| 3,461,018 | 8/1969 | Nagashima | 156/577 |
| 4,131,504 | 12/1978 | Furutu | 156/384 |

*Primary Examiner*—Michael G. Wityshyn

*Attorney, Agent, or Firm*—Ostrolenk, Faber, Gerb & Soffen

[57] ABSTRACT

A label strip jam preventing mechanism for use in a hand labeler wherein the labeler is equipped with a feed mechanism having a feeding roller that is rotatably mounted on the frame of the hand labeler for feeding a continuous label strip. A label strip charging mechanism having a pressure plate covering the feeding roller for assuring engagement between the feeding roller and the label strip. A platen which is reciprocally movable toward and away from a printing head for printing the label strip. The label jam preventing mechanism includes a passage plate which is pivotally connected to the frame and to the platen for providing a passage between the pressure plate and the platen, as the platen shifts in position. A first label holding assembly holds both edges of the label strip at the passage plate. A second label holding assembly holds the both edges and the center portion of the label strip at the pressure plate. Thus, the label strip can be prevented from becoming slack and jamming in the passage between the label supply roll and the platen.

18 Claims, 7 Drawing Figures

LABEL STRIP JAM PREVENTING MECHANISM FOR HAND LABELER

BACKGROUND OF THE INVENTION

1. Field of the Invention

The present invention relates to a label printing and applying machine of portable type (which will be shortly referred to as a "hand labeler" hereinafter), and more particularly to a label jam preventing mechanism for use in the hand labeler, by which a continuous label strip having a series of labels to be printed can be fed smoothly without any jam to a printing platen that is juxtaposed to a printing head. The label jam preventing mechanism finds its most suitable application in the hand labeler of the type, in which the printing head is fixed to the labeler frame while the platen carrying the continuous label strip is made movable to and from the printing head so that the labels of the strip may be printed one by one with preset letters and symbols.

2. Description of the Prior Art

In a hand labeler, or the like, a rolled label strip is fed to a printing position, i.e., onto a platen. To prepare for this feeding operation, the slits formed in the continuous label strip must be fitted in advance onto the feeding projections, which are formed on the outer peripheral surface of a feeding roller that is rotatably mounted in the body of the hand labeler. The feeding roller is then turned to draw and feed the label strip to the printing position.

In a conventional hand labeler, however, the continuous label strip is often slackened or is partially raised from the section of the labeler between the outer peripheral surface of the feeding roller and the platen. This joining section comprises a passage plate interposed between a guiding plate in the vicinity of the feeding roller and the platen such that the passage plate may swing in response to the reciprocal motions of the platen during the printing operation. As a result, the pathway over the passage plate is sometimes jammed with the raised label strip, so that the conventional hand labeler often fails to accomplish the desired smooth feeding of the continuous label strip onto the platen.

SUMMARY OF THE INVENTION

It is therefore, a primary object of the present invention to provide a label jam preventing mechanism for use in a hand labeler.

Another object of the present invention is to provide a label jam preventing mechanism of the above type, in which the passage for a continuous label strip from a feeding roller to a platen can be prevented from being jammed with the label strip.

A hand labeler including a label jam preventing mechanism according to the present invention includes a label strip feed mechanism having a feeding roller that is rotatably mounted on the frame of the hand labeler for feeding a continuous label strip. There is a label strip charging mechanism associated with the feeding roller. It includes a pressure plate opposed to the feeding roller for pressing the label strip to the feeding roller. The pressure plate includes a curved surface that is opposed to and follows the profile of the outer peripheral surface of the feeding roller. A platen reciprocally moves the continuous label strip toward and away from a printing head for the purpose of printing the continuous label strip. The label jam preventing mechanism comprises: a passage plate pivotally connected to the frame of the hand labeler at one end of the passage plate, and typically at that end of the passage plate which is at the pressure plate, i.e. at the frame of the hand labeler. The passage plate thus defines a continuation of the pathway from the charging mechanism. The other end of the pressure plate is attached to the platen for providing a passage for the continuous label strip between the pressure plate and the platen. The passage plate can swing about its connected end with the frame of the hand labeler while holding the platen in position. Label strip holding means are mounted on the passage plate and may also be mounted upsteam of the passage plate in the flow path of the label strip, and particularly in the pressure plate for preventing the continuous label strip from becoming slack. This prevents the passage between the label supply and the platen from being jammed with slack or upraised parts of the continuous label strip.

BRIEF DESCRIPTION OF THE DRAWINGS

Other objects and features of the present invention will become apparent from the following description taken in conjunction with the accompanying drawings, in which.

DESCRIPTION OF THE PREFERRED EMBODIMENT

Figure 1:
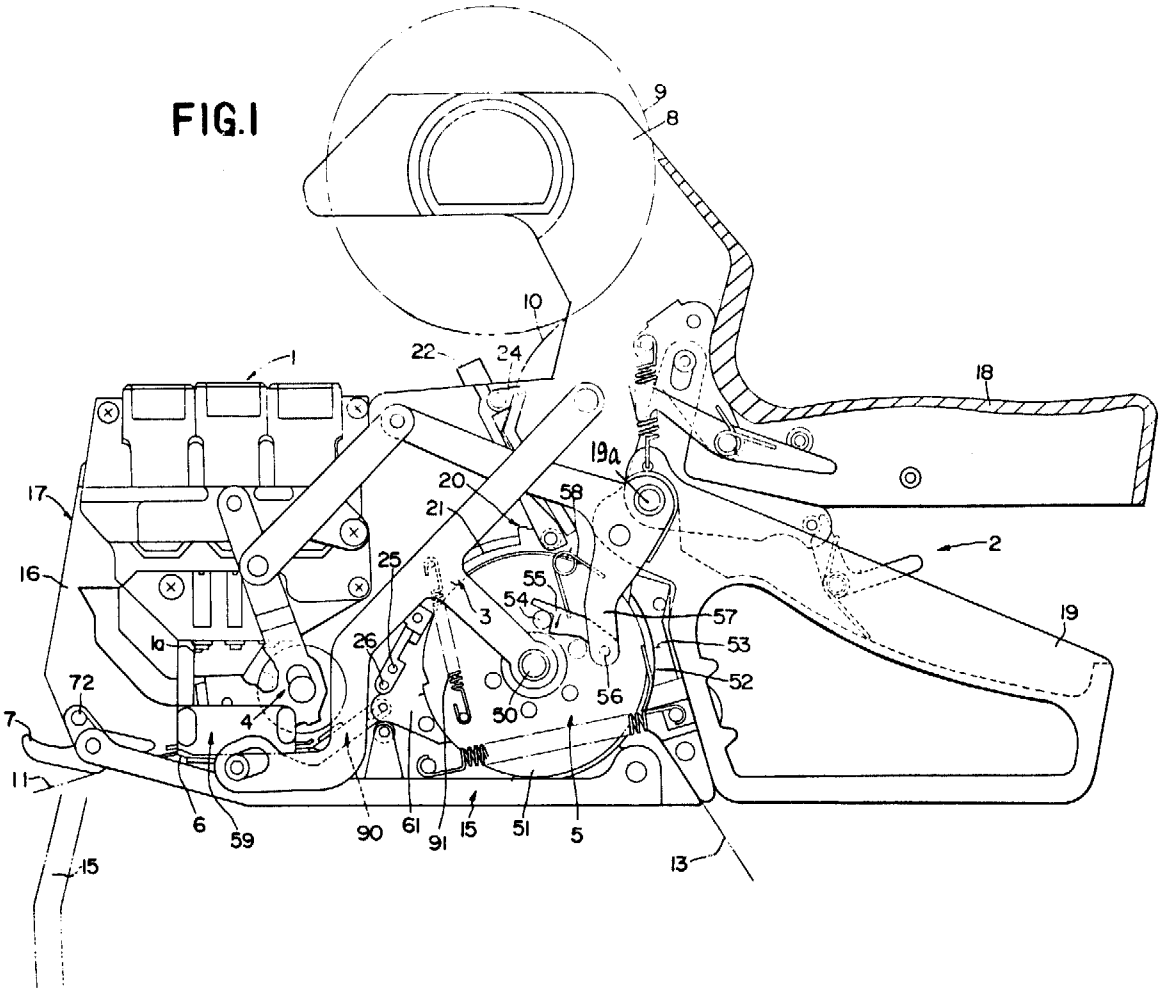
FIG. 1 is a side elevational view showing a hand labeler that is equipped with a label jam preventing mechanism of the invention, with the side frame of the hand labeler on the viewing side removed.

Referring to FIG. 1, a hand labeler is shown. It is comprised of a pair of parallel side frame plates 16 connected at their front, center, rear and lower portions by means of a plurality of support shafts, spindles, spring mounting shafts and stop pins, which together constitute a frame 17 of a hand labeler. The hand labeler has a printing head 1 located at a front upper portion of the frame 17. There is a drive mechanism 2 comprised of a stationary grip 18 integrally formed with the frame 17 at the rear (right hand) portion of the frame. A hand lever 19 is pivotally attached to the frame 17 at pivot **19*a* and pivots toward and away from grip 18. A constant pressure printing mechanism 3 of the type shown in U.S. Pat. No. 4,057,452 for example, incorporated by reference, is located at a center portion of the frames. An ink supply mechanism 4 is located at a front lower portion of the frame 17 and is driven, through appropriate links, by hand lever 19, as shown in U.S. application Ser. No. 716,934, filed Aug. 23, 1976, now abandoned and replaced by Ser. No. 3,626, filed Jan. 15, 1979, a continuation of Ser. No. 716,934, for example, incorporated by reference. There is a feed mechanism 5 at a center lower portion of the frame. A peeling device 6 for peeling a label from the backing strip is located inside the frame at a front lower portion of the hand labeler. A label applying device 7 for applying a printed, separated label is located at a front lower end portion of the frame 17. A label strip holder 8 for holding a rolled continuous label strip 9** is located at a center upper portion of the frame.

The feed mechanism 5 is coactive with the label jam preventing mechanism 90 of the invention. See for example, the feed mechanism shown in U.S. Pat. No. 4,057,452. The feed mechanism 5 comprises a feeding roller 51 which is engageable with a continuous strip 10 of labels. The feeding roller 51 is made rotatable responsive to the releasing of the hand lever 19 after the hand lever has been squeezed, whereby the feeding roller is rotated in an intermittent manner so as to feed the continuous label strip 10.

Figure 2:
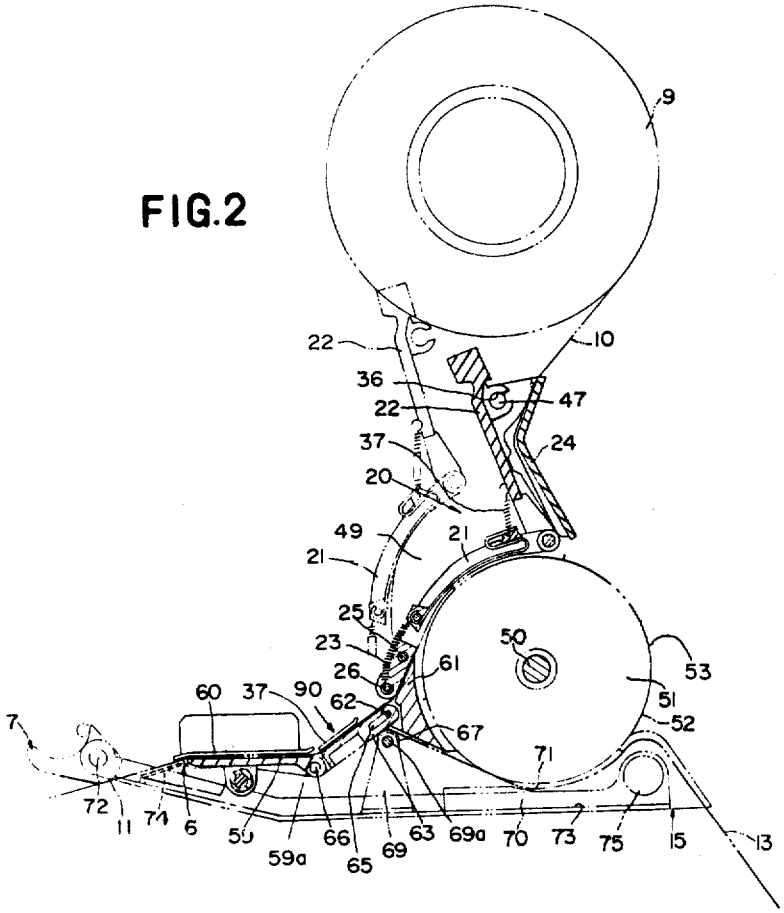
FIG. 2 is a longitudinal sectional view showing essential portions of the hand labeler, including the label jam preventing mechanism of the present invention.

As shown in FIGS. 1 and 2, the feeding roller 51 has on its outer periphery 52 a plurality of rows of feeding claws 53 which are spaced equidistantly from one another. The feeding roller 51 is mounted on a spindle 50 which is in turn rotatably supported in the frame 17. Both sides of the roller 51 carry indexing pins 54, which are arranged on a circle concentric to the spindle 50 and which are equidistantly spaced from one another. Hooks 55 are pivotally connected by means of hook pins 56 to drive levers 57. The hooks 55 and drive levers 57 pivot together with the hand lever 19, and the hooks 55 are biased to turn counter-clockwise by the actions of springs 58. As a result, the leading ends of the hooks 55 are brought into engagement with each indexing pin 54 in turn, in a ratchet manner, so that the feeding roller 51 may be rotated counter-clockwise in FIGS. 1 and 2 intermittently about the spindle 50.

Figure 3:
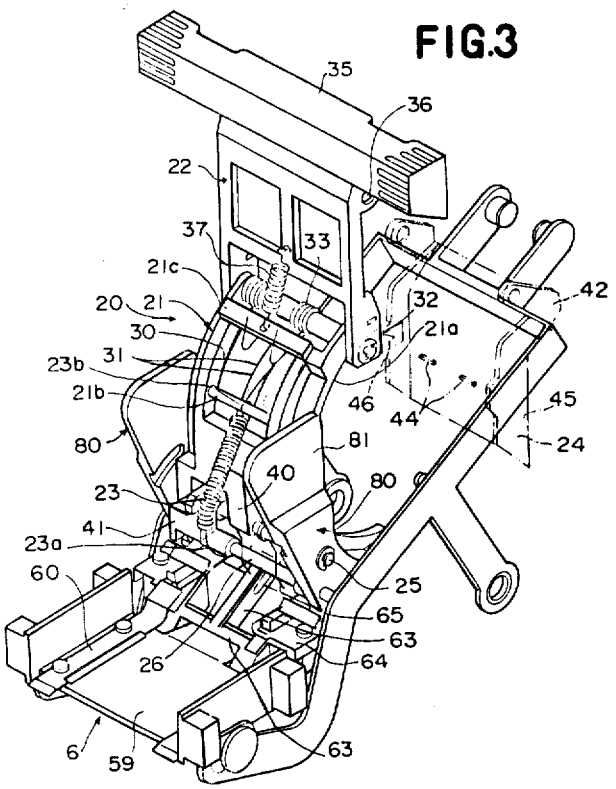
FIG. 3 is a perspective view showing the label jam preventing mechanism of the present invention.
Figures 4, 5:
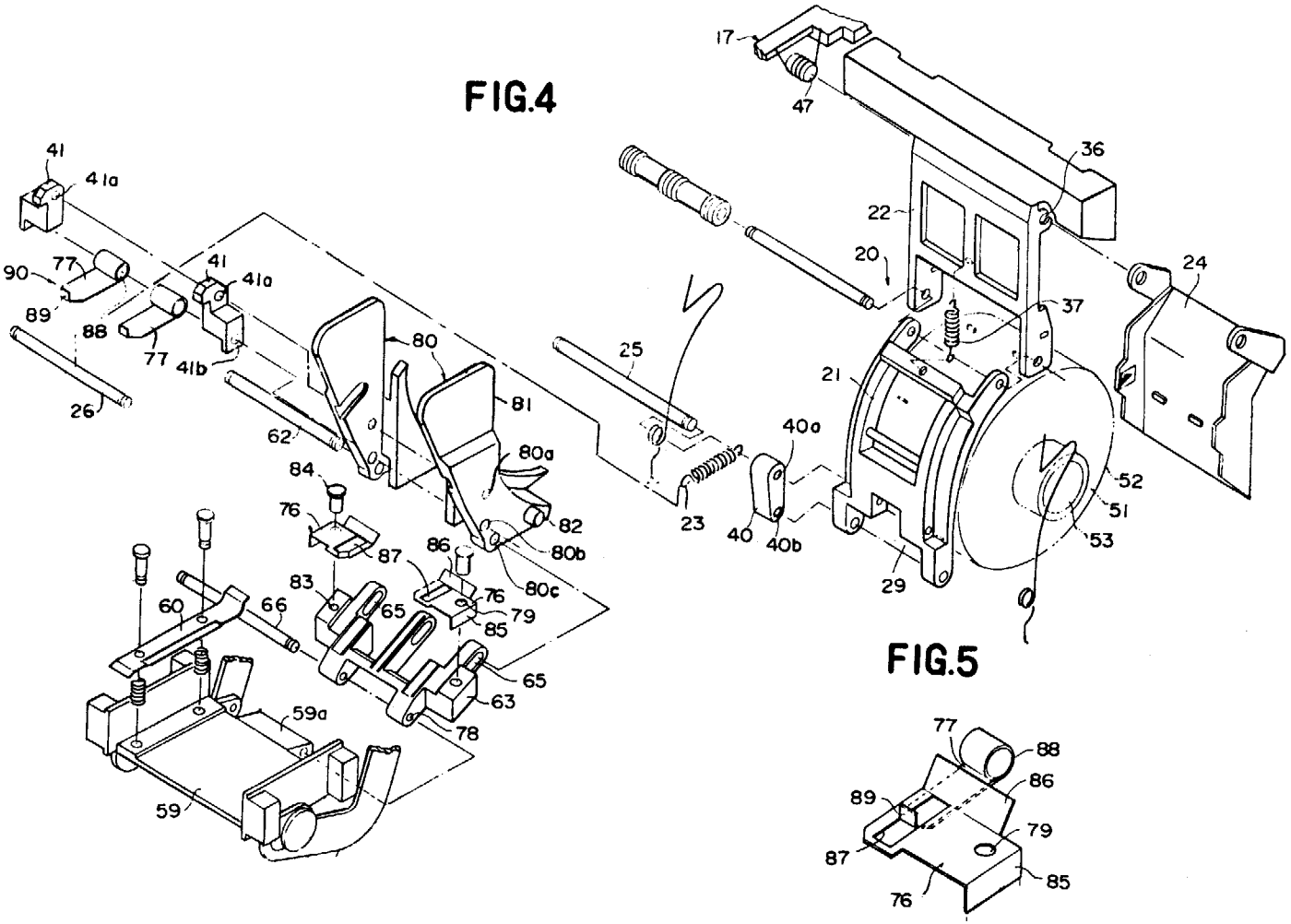
FIG. 4 is an exploded perspective view showing the assembly of the label jam preventing mechanism of the present invention.
FIG. 5 is a perspective view showing the engaging relationship between the label edge guide plates and the sliding members of the label jam preventing mechanism of the present invention.

The construction and operation of a label strip charging mechanism 20 is now described. It is the subject of U.S. application Ser. No. 938,422, filed by the applicant of even date herewith, entitled "Label Strip Charging Mechanism for Hand Labeler". This mechanism 20 is located upstream, with respect to the advancement of the continuous label strip 10, whereby the label strip 10 is fed to the label jam preventing mechanism 90 of the present invention by the label strip charging mechanism 20. As shown in FIGS. 2–4, the charging mechanism 20 includes a pressure plate 21 which has a curved rearwardly facing surface whose curvature is opposed to and follows the profile of the outer peripheral surface 52 of the feeding roller 51.

An actuating lever 22 is provided above the pressure plate 21 and is pivotally connected thereto through a spring 37. Below the pressure plate 21, there is a coil spring 23 which is mounted to a support pin 26 and also to a portion of the pressure plate 21, whereby the plate 21 is biased in the direction apart from the feeding roller 51 by the spring 23. The upper rear portions of the actuating lever 22 carry respective notches 36, which constitute resilient retaining means that snap together with support pins 47 which are formed in the frame 17. Thus, a snap action retains the pressure plate 21 in the vicinity of the feeding roller 51.

Above and upstream of the feeding roller 51, there is a label guide member 24 which is juxtaposed to and opposed to the actuating lever 22 thereby defining an opening to facilitate the insertion of the continuous label strip 10. At both sides of the feeding roller 51, there are a pair of label edge guide members 80, which are sized and positioned to guide both edges of the label strip 10 and to regulate it widthwise. The guide members 80 have upwardly extending label strip regulating portions 81 and also have outside projections 82 so that they may be fixed to the machine frame 17 through their projections 82. The guide members 80 have pin holes **80*a*, 80*b* and 80*c*, which respectively receive an upper support pin 25 and a lower support pin 26 that both extend across the recess 29 of the pressure plate 21 and that also receive a pin 66 of a below described guide plate 61**.

The label jam preventing mechanism 90 according to the invention includes a first pressure member 40, which is mounted to a lower portion of the pressure plate 21 covering the outer peripheral surface 52 of the feeding roller 51 for holding the center portion of the label strip 10. It further includes a pair of second pressure members 41, which are also mounted to a lower portion of the pressure plate 21 for holding both edges of the label strip 10. The first and second pressure members 40 and 41 are formed with pin holes **40*a*, 40*b*, and 41*a*, 41*b*, in which the support pins 25 and 26** are fitted, respectively.

There is a passage plate 63, which is pivotally connected at its forward end to the platen 59. At its rear end, plate 63 is connected to a fixedly positioned guide plate 61 disposed below the feeding roller 51 and which is fixed to the frame 17. The passage plate 63 is positioned below and downstream in the flow path of the label strip from the feeding roller 51. In particular, the passage plate 63 has a pair of rearwardly (rightwardly in the drawings) extending arms, the rear ends of which have slots 65. The slots 65 receive a pin 62 of the guide plate 61. The plate 63 has a pair of forwardly extending arms that have pin receiving holes 78, which receive a pin 66 of a connecting portion **59*a* of the platen 59**.

Figure 6:
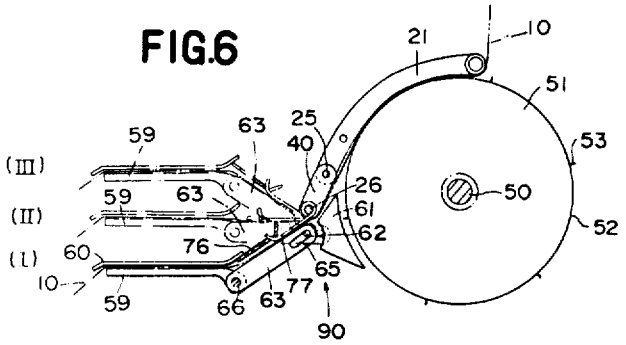
FIG. 6 is an explanatory view showing the operating conditions of the label jam preventing mechanism of the present invention.

A pair of label edge guide plates 76 are mounted to the passage plate 63. A pair of sliding members 77 are arranged, as described below to engage with the label edge guide plates 76, respectively. The edges of the label strip pass under the label edge guide plates 76, as shown in FIG. 6. The label edge guide plates 76 are mounted at both sides of the passage plate 63 at a spacing above the plate slightly larger than the thickness of the label strip 10. The plates 76 are also spaced apart less than the width of the label strip so that they both overlie the label strip. This attachment is accomplished by inserting pins 84 through the pin holes 79 of the guide plates 76 into the pin holes 83 of the passage plate 63. Each label edge guide plate 76 is formed at its outside with a depending guide plate guide and positioning wall 85, which is bent downwardly, and is formed at its inlet or rear side, with an upwardly bent guide wall 86, for deflecting the label strip 10 down under the guide plates 76. The guide plate 76 includes an opening 87 at its flat portion.

Each label edge guide plate 76 engages the corresponding one of the sliding members 77 at the respective opening 87 of the guide plate. The sliding members 77 are fitted on and pivotable around the support pin 76. For this purpose, each sliding member 77 includes a connecting portion or opening 88 at its rear portion into which the support pin 26 is loosely fitted. At its forward end, each sliding member 77 includes a retaining tip 89, which is bent upwardly so that it may engage in the opening 87 of the corresponding guide plate 76, as seen in FIG. 5. The spacing between the sliding members is such that each also engages the label strip 10 before the strip passes under the rear wall 86. This assures that there is a continuous guided pathway for the label strip from the pressure plate 21 past the guide plate 61 and the pin 26 to the platen 59.

A pair of label guide plates 60 are mounted to both sides of the platen 59 for holding down both side edges of the continuous label strip 10.

Figure 7:
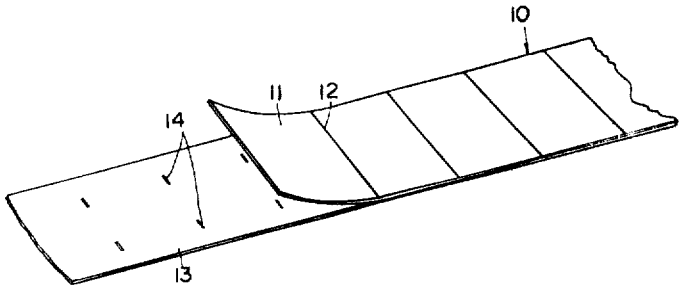
FIG. 7 is a perspective view showing a portion of a continuous label strip used with the hand labeler.

As shown in FIG. 7, the label strip 10 is formed with slits 14, which are positioned on the backing paper 13 and which correspond to slits 12 in each label 11. The slits 12, 14 are spaced lengthwise of the label strip at a preset pitch.

The continuous label strip 10 is advanced over the platen 59 to the peeling device 6, where the strip 10 is separated into the labels 11 and the backing paper 13, and only the backing paper is guided rearwardly to move below the feeding roller 51.

Referring to FIG. 2, in order to guide the backing paper 13 toward the feeding roller 51, a bottom cover 15 is provided. It has a dish shaped bottom plate 73 that is pivotally connected at its forward end to the frame 17 by a pivot pin 72. A label receiver 74 is arranged to the rear of the pivot pin 72. To the rear of the label receiver 74, there is arranged a support base 69, on the upper end of which a backing paper carrier roller 67 is rotatably supported by means of a pivot pin 69*a*. Behind the support base 69, there is a backing paper guide 70, which is formed with a curved surface 71 that faces to the lower outer periphery of the feeding roller 51. From the peeling device 6, the backing paper is directed to pass through a passage which is formed between the curved surface 71 of the backing paper guide 70 and the outer peripheral surface 52 of the feeding roller 51.

All of the label receiver 74, the support base and the backing paper guide 70 are secured to the bottom plate 73 of the cover 15 in the above described positional relationships. The bottom cover 15 is disengaged from the frame 17 when release buttons 75 are depressed by the fingers of an operator, which frees the plate to rotate downwardly about the pivot pin 72 until it is opened to the position shown in dash-dotted lines in FIG. 1.

The afore-mentioned label applying device 7 is mounted to the pivot pin 72 that connects the bottom cover 15 pivotally to the frame 17. The device 7 is operative to apply the label 11, that has been peeled from the backing paper 13 and has been delivered to the outside of the frame 17, to a commodity.

Prior to the operation of the label jam preventing mechanism 90, the continuous label strip 10 is set in the label strip charging mechanism 20 shown in FIG. 2. Briefly, the actuating lever 22 is pinched and pulled by the fingers of the operator until the engagement between the notches 36 and the support pins 47 is released. As a result, the pressure plate 21, which had been held toward the outer peripheral surface 52 of the feeding roller 51, is separated therefrom, as shown in the dash-dotted lines in FIG. 2, by the compressions of the tension springs 23 and 37, thus establishing an enlarged clearance 49 between the plate 21 and the roller 51. The slits 14 of the continuous label strip 10 are brought into engagement with the feeding claws 53 of the feeding roller 51. Then the actuating lever 22 is returned to its original position, shown in solid lines in FIG. 2, thus completing the charging operation of the label strip 10. For further details, see the aforesaid copending application.

Next, the hand lever 19 is squeezed and released to turn the feeding roller 51 counter-clockwise in an intermittent manner. In accordance with such rotational motion, the label strip 10 is fed in an indexed manner onto the platen 59 by the action of the feeding roller 51.

Referring to FIGS. 1 and 6, the operation of the label jam preventing mechanism 90 is now described. The constant pressure printing mechanism 3 is actuated by the gripping action of the hand lever 19, and the platen 59 is raised from its rest position (I), through an intermediate position (II) to its printing position (III). In the latter position, the platen is in contact with the type surfaces 1*a* of the printing head 1 which prints the label 11 on the platen with preset indicia. Afterward, the platen 59 is returned to the rest position (I) by the return spring 91.

In response to the vertical movement of the platen 59, the passage plate 63, which acts as a connecting member between the platen 59 and the guide plate 61 of the feeding roller 51, can swing so that the continuous label strip 10 passing thereover can be prevented from being locally raised or slackened.

The path of the continuous label strip 10 from the support 8 is described. Label strip 10 is held by the pressure plate 21, while it is engaged by the feeding roller 51, as well as by the grouped pressure members which are mounted to the lower portion of the pressure plate 21. The center portion of the label strip 10 is held by the first pressure member 40 while the both edge portions of the strip are held by the second pressure members 41.

The advancing label strip 10 reaches the passage plate 63 leading to the platen 59. The passage plate 63 is responsive to the vertical movements of the platen 59 during the label printing and the plate 63 can swing about the pin 62 of the guide plate 61 through the engagement between the slots 65 of the plate 63 and the pin 62, such that the slots 65 slide on the pin 62.

Often, the label strip 10 is locally raised apart from the passage plate 63. This can be prevented by the invention. Both side edges of the label strip 10 are held in position under the paired label edge guide plates 76 and the sliding members 77, which slidably engage with the openings 87 of the guide plate 76. Moreover, the sliding members 77 are capable of sliding in and do slide along the openings 87 of the guide plates 76 because members 77 are held by the pin 26 during the swinging motions of the passage plate 63. Because the label strip 10 is restrained from below by the passage plate 63 and from above by the guide plates 76 and the sliding members 77, the label strip cannot rise up and bunch up as the label strip is being fed and as the platen rises and descends.

After the label strip 10 passes over the passage plate 63, it advances to the platen 59. Here, printing is performed while both edges of the label strip 10 are held in position by the paired label guide plates 60. The label strip 10 continues to the front of the platen 59.

Although the foregoing description has been directed to a particular example of a charging mechanism for the label strip 10 and a particular peeling arrangement for separating the labels from the backing strip, it should be understood that the mechanism 90 according to the present invention can also prevent the pathway connecting the pressure plate 21 and the platen 59 from being jammed with the label strip 10, when the label strip 10 has its backing paper 13 returned rearwardly at the leading end of the platen 59 or elsewhere in the labeler, for normal operation of the hand labeler.

As has been described hereinbefore, the label jam preventing mechanism of the present invention includes a passage plate connected pivotally to the frame of the hand labeler and to the platen for providing a passage for a continuous label strip. The passage plate can swing about its end connected to the frame while holding the platen in position. There are label holding means mounted on the passage plate and also, desirably, in a pressure plate upstream of the passage plate. The pressure plate cooperates with the feed roller to engage the label strip. Thus, the local rise of the label strip, which might otherwise take place as a result of the swinging motions of the passage plate in response to the reciprocal motions of the platen, can be completely prevented by the combined actions of the members of the label holding means. Therefore, the label strip can be smoothly let out without any jam, during the printing operation of the platen.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A hand labeler, comprising:

a frame;

a platen supported on said frame; a printing head supported by said frame and opposable to a label on said platen for printing the label on said platen as said platen is brought into engagement with said printing head;

a feeding roller rotatably mounted on said frame for feeding a continuous label strip to said platen as said feeding roller is rotated; means for rotating said feeding roller;

a label strip charging mechanism for directing the label strip to pass by and to engage said feeding roller;

said platen being placed for receiving the label strip after the label strip has moved past said charging mechanism and said feeding roller; means for alternately moving said platen toward and away from said printing head for bringing a label on said platen into engagement with said printing head, as said platen is moved toward said printing head; said motion of said platen being with respect to said label strip charging mechanism;

a label jam preventing mechanism comprising a passage plate pivotally connected to said platen for defining a continuous path up to said platen; said passage plate also communicating with said label strip charging mechanism for defining a continuous path from said charging mechanism to said passage plate; said passage plate being swingable with respect to said charging mechanism and with respect to said platen as said platen moves;

label strip holding means on said passage plate for holding the label strip to said passage plate as said passage plate moves toward and away from said printing head, thereby preventing the label strip from becoming slack.

2. The hand labeler of claim 1, wherein said label strip holding means includes an assembly on said passage plate for holding both edges of the continuous label strip against said passage plate as said passage plate is moved with said platen.

3. The hand labeler of claim 2, wherein said assembly includes a pair of label edge guide plates mounted to said passage plate at both sides and spaced apart from each other and being spaced from said passage plate a distance slightly larger than the thickness of the continuous label strip whereby the label strip may pass between said passage plate and said edge guide plates; said label edge guide plates being placed to overlie the edges of the label strip.

4. The labeler of claim 3, wherein said assembly further comprises a respective sliding member for each said label guide plate; each said sliding member having one end thereof pivotally connected to said label strip charging mechanism and having another end thereof in engagement with the respective said label edge guide plate, in a manner such that said sliding member may slide relative to its said label edge guide plate as said passage plate moves with said platen.

5. The labeler of claim 1, wherein said label strip charging mechanism comprises a pressure plate having a surface opposed to said feeding roller; said label jam preventing mechanism further comprises second label strip holding means mounted on said pressure plate for holding the label strip to said feeding roller for cooperating with the first said label strip holding means for preventing the label strip from becoming slack.

6. The labeler of claim 5, wherein said pressure plate surface is a curved surface that follows the profile of said feeding roller for directing the label strip against said feeding roller.

7. The labeler of claim 5, said first label strip holding means includes an assembly on said passage plate for holding both edges of the continuous label strip against said passage plate as said passage plate is moved with said platen.

8. The labeler of claim 7, wherein said assembly includes a pair of label edge guide plates mounted to said passage plate at both sides and spaced apart from each other and being spaced from said passage plate a distance slightly larger than the thickness of the continuous label strip whereby the label strip may pass between said passage plate and said edge guide plates; said label edge guide plates being placed to overlie the edges of the label strip.

9. The labeler of claim 8, wherein said assembly further comprises a respective sliding member for each said label guide plate; each said sliding member having one end thereof pivotally connected to said pressure plate and having another end thereof in engagement with the respective said label edge guide plate, in a manner such that said sliding member may slide relative to its said label edge guide plate as said passage plate moves with said platen.

10. The labeler of claim 9, wherein said pressure plate surface is a curved surface that follows the profile of said feeding roller for directing the label strip against said feeding roller.

11. The labeler of claim 10, wherein said second label strip holding means includes a label holding assembly for holding both edges and the center portion of the label strip at said pressure plate.

12. The labeler of claim 11, wherein said label holding assembly includes a first pressure member for holding the center portion of the continuous label strip and further includes a pair of second pressure members for holding both edges of the continuous label strip.

13. The labeler of claim 5, wherein said second label strip holding means includes a label holding assembly for holding both edges and the center portion of the label strip at said pressure plate.

14. The labeler of claim 13, wherein said label holding assembly includes a first pressure member for holding the center portion of the continuous label strip and further includes a pair of second pressure members for holding both edges of the continuous label strip.

15. A hand labeler, comprising:

a frame;

a printing head supported by said frame and opposable to a label on a platen for printing the label on the platen as the platen is brought into engagement with said printing head;

feeding means for feeding a continuous label strip to said platen;

a label strip charging mechanism for directing the label strip to pass by said feeding means, thereby enabling said feeding means to feed the label strip;

said platen being placed for receiving the label strip after the label strip has moved past said charging mechanism and said feeding means; means for alternately moving said platen toward and away from said printing head for bringing a label on said platen into engagement with said printing head as said platen is moved toward said printing head; said motion of said platen being with respect to said label strip charging mechanism;

a passage plate pivotally connected to said platen for defining a continuous path up to said platen; said passage plate also communicating with said label strip charging mechanism for defining a continuous path from said charging mechanism to said passage plate; said passage plate being swingable with respect to said charging mechanism and with respect to said platen as said platen moves;

first label strip holding means on said passage plate for holding the label strip to said passage plate as said passage plate moves toward and away from said printing head, thereby preventing the label strip from becoming slack.

16. The labeler of claim 15, wherein said first label strip holding means includes an assembly on said passage plate for holding both edges of the continuous label strip against said passage plate as said passage plate is moved with said platen.

17. The labeler of claim 16, wherein said assembly includes a pair of label edge guide plates mounted to said passage plate at both sides and spaced apart from each other and being spaced from said passage plate a distance slightly larger than the thickness of the continuous label strip; said label edge guide plates being placed to overlie the edges of the label strip.

18. The labeler of claim 17, wherein said assembly further comprises a respective sliding member for each said label guide plate; each said sliding member having one end thereof pivotally connected to said pressure plate and having another end thereof in engagement with the respective said label edge guide plate, in a manner such that said sliding member may slide relative to its said label edge guide plate as said passage plate moves with said platen.

* * * * *